US006876180B2

(12) United States Patent
Suzuki et al.

(10) Patent No.: US 6,876,180 B2
(45) Date of Patent: Apr. 5, 2005

(54) POWER SUPPLY CIRCUIT HAVING A START UP CIRCUIT

(75) Inventors: Akira Suzuki, Nukata-gun (JP); Hirofumi Abe, Kamagoori (JP); Hideaki Ishihara, Okazaki (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/292,125

(22) Filed: Nov. 11, 2002

(65) Prior Publication Data

US 2003/0090249 A1 May 15, 2003

(30) Foreign Application Priority Data

Nov. 12, 2001 (JP) ..... 2001-346226

(51) Int. Cl.[7] ..... G05F 1/40; G05F 1/56; G05F 1/44

(52) U.S. Cl. ..... 323/270; 323/268; 323/284

(58) Field of Search ..... 323/268, 270, 323/266, 282, 284

(56) References Cited

U.S. PATENT DOCUMENTS 4,456,833 A * 6/1984 Traub et al. ..... 307/80
5,864,225 A * 1/1999 Bryson ..... 323/268
6,130,525 A * 10/2000 Jung et al. ..... 323/268
6,232,753 B1 * 5/2001 Pasotti et al. ..... 323/267
6,259,240 B1 * 7/2001 Smith ..... 323/313
6,384,586 B1 * 5/2002 Sugawara ..... 323/313
6,445,167 B1 * 9/2002 Marty ..... 323/280
6,614,706 B2 * 9/2003 Feurle ..... 365/226
6,686,795 B2 * 2/2004 Hisano ..... 327/538

FOREIGN PATENT DOCUMENTS

| | | |
|---|---|---|
| JP | 54-21239 | 2/1979 |
| JP | 57-50105 | 3/1982 |
| JP | 59-154805 | 9/1984 |
| JP | 60-261206 | 12/1985 |
| JP | 7-182060 | 7/1995 |
| JP | 8-23236 | 1/1996 |

* cited by examiner

*Primary Examiner*—Bao Q. Vu
(74) *Attorney, Agent, or Firm*—Harness, Dickey & Pierce, PLC

(57) ABSTRACT

A reference voltage circuit and an operational amplifier operate when an output voltage is produced from an output terminal of a power supply circuit. When the output voltage is low in the rising phase of a power source voltage, a transistor Q17 in a startup circuit turns on and a transistor Q14 turns off to surely turn on transistors Q11 and Q12. Upon the output voltage exceeding a predetermined level, the transistor Q17 turns off and an ordinary feedback control starts.

7 Claims, 4 Drawing Sheets

POWER SUPPLY CIRCUIT HAVING A START UP CIRCUIT

BACKGROUND OF THE INVENTION

This invention relates to a series regulator type power supply circuit.

FIG. 3A shows a circuit arrangement of a series regulator type power supply circuit conventionally used for an ECU (i.e., electronic control unit) installed in an automotive vehicle. As shown in FIG. 3A, a power supply circuit 1 includes a control IC (i.e., integrated circuit) 2 manufactured by the CMOS processes, a transistor Q1 for lowering or reducing the voltage, a transistor Q2 for activating the transistor Q1, a plurality of resistors R1–R4, and a reverse connection protecting diode D1. The power supply circuit 1 has a power input terminal 3 receiving a battery voltage VB supplied from a battery (not shown). The power supply circuit 1 has a terminal 4 producing a constant voltage of 5V under the constant voltage control performed by the IC 2.

The IC 2 includes a reference voltage circuit 5 (e.g., a band-gap reference voltage circuit) for generating a reference voltage Vr, an output voltage detecting circuit 6 consisting of two resistors R5 and R6 which are serially connected, an operational amplifier 8 for controlling the transistor Q2 via a terminal of IC2 based on a difference between the reference voltage Vr and a detection voltage Va, a clamp circuit 9 for supplying a power supply voltage (approximately 5V) to the reference voltage circuit 5 and to the operational amplifier 8, and other circuits operating in response to the generated constant voltage of 5V.

The clamp circuit 9, as shown in FIG. 3B, includes a plurality of P-channel transistors Q3 to Q6 and an N-channel transistor Q7. Each of the plurality of transistors Q3 to Q7 has a gate and a drain directly or commonly connected to each other. The battery voltage VB entering from the power input terminal 3 is applied to the clamp circuit 9 via the diode D1, the resistor R4, and a terminal 10 of IC2.

The resistor R4, determining a clamp current $I_{CLMP}$ supplied to the clamp circuit 9, has a relatively small resistance value so that the a sufficient amount of operation current can be supplied to each of the reference voltage circuit 5 and to the operational amplifier 8 even when the battery voltage VB is reduced to a minimum voltage level (e.g., 8V). The clamp current $I_{CLMP}$ increases with increasing battery voltage VB. The current consumption in the power supply circuit 1 increases correspondingly. Especially, when the power supply circuit 1 is used for the ECU or another automotive device mounted on a vehicle body, the power consumption of the battery increases.

SUMMARY OF THE INVENTION

In view of the above-described problems, the present invention has an object to provide a series regulator type power supply circuit which is capable of effectively reducing the current consumption.

In order to accomplish the above and other related objects, the present invention provides a power supply circuit including a main transistor provided in a current path extending from a power input terminal to a power output terminal of the power supply circuit for lowering or reducing a voltage in accordance with a given drive signal. A voltage detecting circuit detects an output voltage appearing from the power output terminal of the power supply circuit. A voltage control circuit, operable in response to the output voltage produced from the output terminal, performs a closed-loop control to supply a first drive signal to the main transistor so that the output voltage detected by the voltage detecting circuit can be equalized to a target voltage. And, a startup circuit performs a control to supply a second drive signal to the main transistor so that the main transistor can surely turn on during a low output voltage period where the output voltage is lower than a predetermined voltage. Preferably, the power supply circuit further comprises a reference voltage circuit which is operable in response to the output voltage produced from the output terminal for generating a reference voltage corresponding to the target voltage.

Preferably, the voltage control circuit and the startup circuit are constituted by a single operational amplifier including an output transistor. A drive circuit, interposing between the operational amplifier and the main transistor, drives the main transistor. And, the startup circuit fixes a control terminal of the output transistor of the operational amplifier to a predetermined potential so that the drive circuit can supply the second drive signal to the main transistor during the low output voltage period.

Preferably, the drive circuit supplies the second drive signal to the main transistor under a condition where the output transistor of the operational amplifier is in a turned-off condition. And, the startup circuit includes a shutoff transistor which is serially connected to the output transistor of the operational amplifier and is in a turned-off state during the low output voltage period.

Preferably, the power input terminal receives a battery voltage.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

A preferred embodiment of the present invention will be explained hereinafter with reference to attached drawings.

Figure 1A:
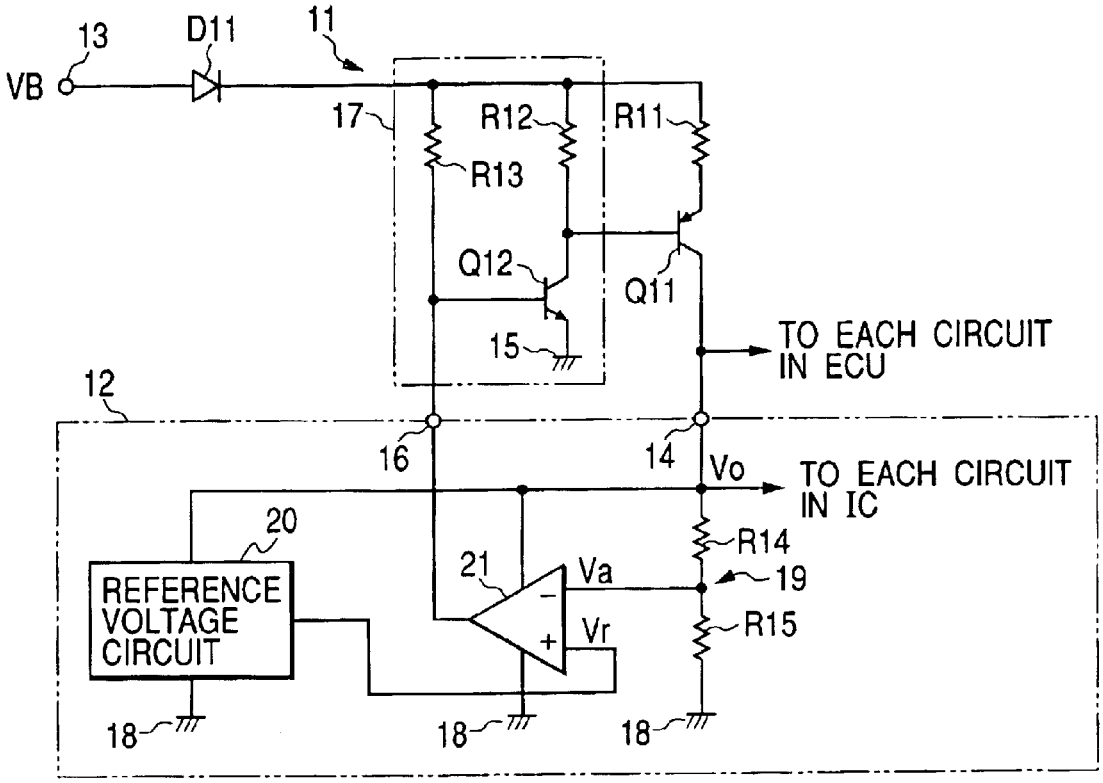
FIG. 1A is a circuit diagram showing a power supply circuit in accordance with a preferred embodiment of the present invention.

FIG. 1A is a circuit diagram showing a series regulator type power supply circuit. A power supply circuit 11 shown in FIG. 1A supplies electric power to an IC (i.e., integrated circuit) 12 as well as to a 5V circuit which are both used in an ECU (i.e., electronic control unit) installed in an automotive vehicle. The power supply circuit 11 has a power input terminal 13 which inputs a power source voltage applied from a battery (not shown). The power source voltage, referred to as a battery voltage VB, is approximately 12V. The power supply circuit 11, serving as a constant-voltage power supply circuit, generates a constant voltage Vo of 5V which is produced from a terminal 14 of IC 12. The terminal 14 of IC 12 serves as a power output terminal.

The IC 12 includes various analog/digital circuits relating to the control of ECU in addition to a control circuit of the power supply circuit 11. Furthermore, the IC 12, manufactured by the CMOS processes, has a low withstand voltage of approximately 5.5V. Therefore, as explained hereinafter, the circuit arrangement prevents the battery voltage VB from being directly applied to IC 12.

A serial connection of a diode D11, a first resistor R11, and an emitter-collector junction of a PNP transistor Q11 (serving as a main transistor) interposes between the power input terminal 13 and the power output terminal 14 of IC 12. The diode D11 is a reverse connection protecting diode. A collector-emitter junction of an NPN transistor Q12 interposes between a base of PNP transistor Q11 and a ground line 15. A second resistor R12 interposes between the base of PNP transistor Q11 and a cathode of diode D11. A third resistor R13 interposes between the base of NPN transistor Q12 and the cathode of diode D11. According to this circuit arrangement, the NPN transistor Q12 and the second and third transistors R12 and R13 cooperatively constitute a drive circuit 17 for driving the PNP transistor Q11.

According to the circuit arrangement of IC 12, a serial connection of fourth and fifth, i.e., voltage dividing, resistors R14 and R15 interposes between the terminal 14 and a ground line 18. The electric potential of the ground line 18 is equal to the electric potential of the ground line 15. The serial connection of the fourth and fifth resistors R14 and R15, serving as a voltage detecting circuit 19, produces a detection voltage Va from a joint point of the fourth and fifth resistors R14 and R15. In this respect, the detection voltage Va is proportional to the output voltage Vo of the power supply circuit 11 at a dividing ratio (i.e., $Va=Vo\cdot R15/(R14+R15)$).

Figure 1B:
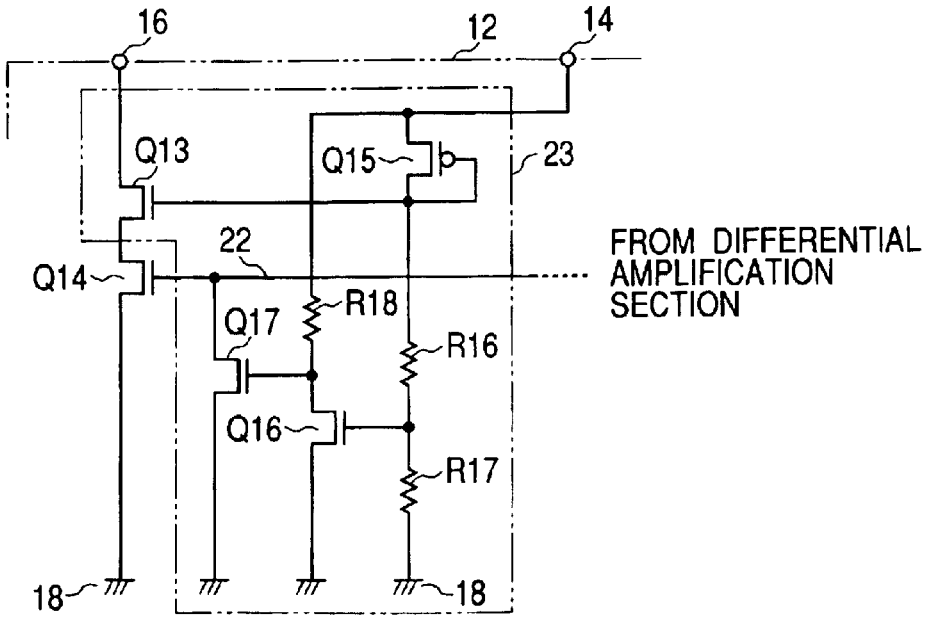
FIG. 1B is a circuit diagram showing a detailed arrangement of an output section of the power supply circuit in accordance with a preferred embodiment of the present invention.

A reference voltage circuit 20, such as a band-gap reference voltage circuit, generates a reference voltage Vr in response to power supply (i.e., the output voltage Vo) entering from the terminal 14. The reference voltage Vr is a value corresponding to a target voltage (e.g., 5V) of the output voltage Vo; namely, the reference voltage Vr is equal to $5\cdot R15/(R14+R15)$ An operational amplifier 21 serves as a voltage control circuit and also as a startup circuit of the present invention. Like the reference voltage circuit 20, the operational amplifier 21 operates (starts its operation) in response to the output voltage Vo entering from the terminal 14. The operational amplifier 21 has an inverting input terminal receiving the detection voltage Va and a non-inverting input terminal receiving the reference voltage Vr. The operational amplifier 21 has an output terminal connected to a terminal 16 of IC 12. FIG. 1B shows an electric arrangement of an output section of the operational amplifier 21.

As shown in FIG. 1B, a serial connection of an N-channel transistor Q13 and an N-channel transistor Q14 interposes between the terminal 16 and the ground line 18. The N-channel transistor Q13 serves as a shutoff transistor. The serial connection of the transistors Q13 and Q14 forms an open-drain circuit arrangement. The N-channel transistor Q14 is an output transistor of the operational amplifier 21. A gate of transistor Q14 receives a differential amplification signal via a signal line 22 from a differential amplification section (not shown) of the operational amplifier 21. The differential amplification signal is an amplified signal representing a differential voltage between the detection voltage Va and the reference voltage Vr.

Figure 4:
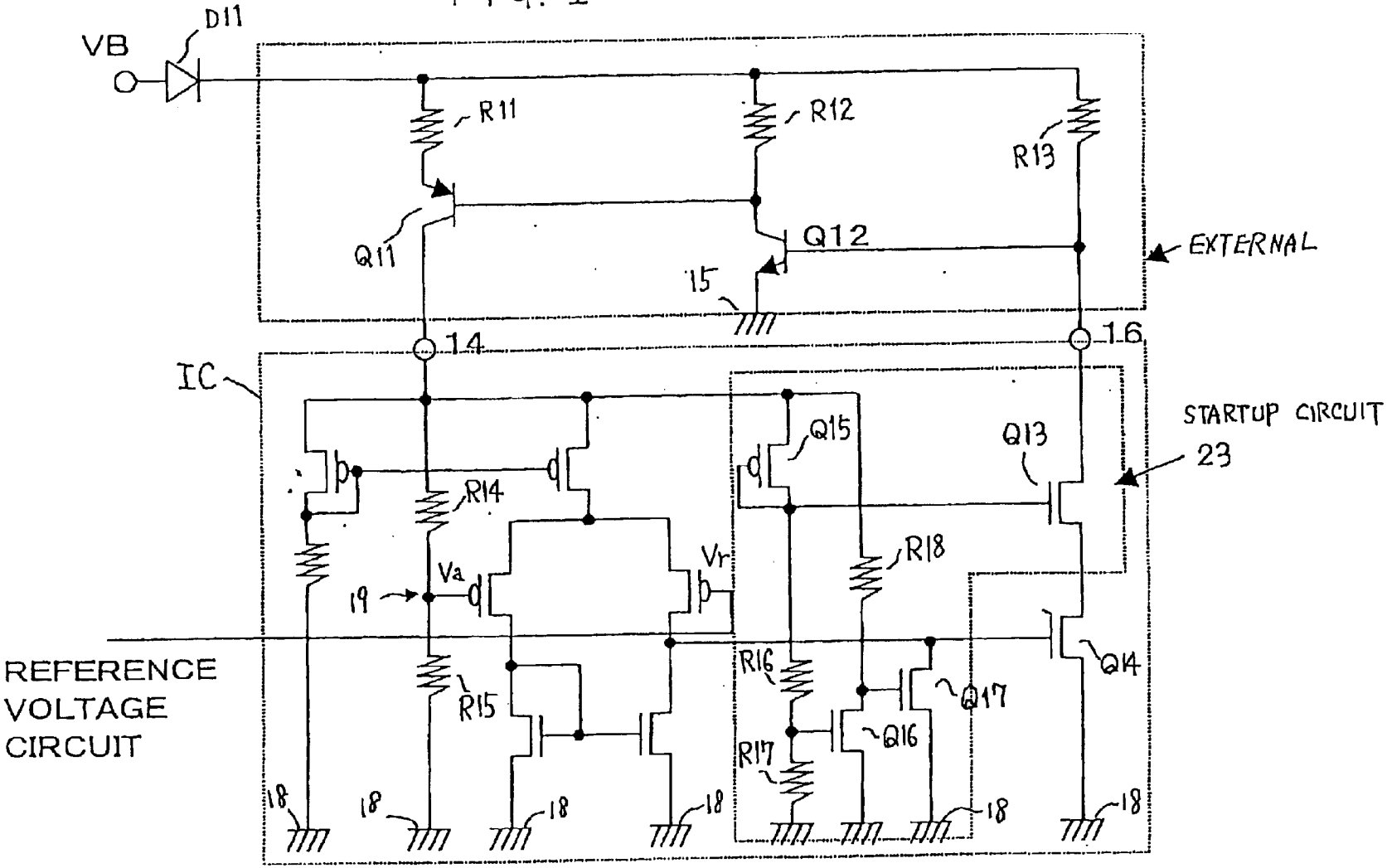
FIG. 4 is a circuit diagram showing an overall circuit arrangement in accordance with the preferred embodiment of the present invention.

A serial connection of a source-drain junction of P-channel transistor Q15 and sixth and seventh resistors R16 and R17 interposes between the terminal 14 and the ground line 18. The P-channel transistor Q15 has a gate directly connected to its drain and to the gate of N-channel transistor Q13. In other words, the gate of transistor Q13 is commonly connected to the drain and gate of transistor Q15. A serial connection of an eighth resistor R18 and a drain-source junction of an N-channel transistor Q16 interposes between the terminal 14 and the ground line 18. The N-channel transistor Q16 has a gate connected to a joint point of the sixth and seventh resistors R16 and R17. The N-channel transistor Q16 has a drain connected to a gate of an N-channel transistor Q17. The N-channel transistor Q17 has a drain connected to the signal line 22 and a source connected to the ground line 18. The above-described output section of the operational amplifier 21, except for the transistor Q14, constitutes the startup circuit 23. FIG. 4 illustrates an overall circuit arrangement for the cower supply circuit, where the startup circuit 23 is integrated with the power supply circuit of FIG. 1A in the manner described above.

The power supply circuit 11 has the following functions and effects as explained with reference to the time diagram shown in FIG. 2.

In the control circuit of the power supply circuit 11, both the reference voltage circuit 20 and the operational amplifier 21 operate (i.e., start their operations) when the power supply circuit 11 itself generates the output voltage Vo. Therefore, no special power source (such as a clamp circuit) is necessary for the control circuit of the power supply circuit 11. Compared with the conventional power supply circuit 1 shown in FIG. 3 which requires the clamp circuit 9, the circuit arrangement shown in FIG. 1 is advantageous in that the current consumption required for activating the clamp circuit 9 is not necessary. Especially, when an input voltage is the battery voltage VB (having a minimum voltage 8V according to the specifications) which has the tendency of causing large fluctuations, the current consumption in the clamp circuit 9 tends to become large.

Figure 3A:
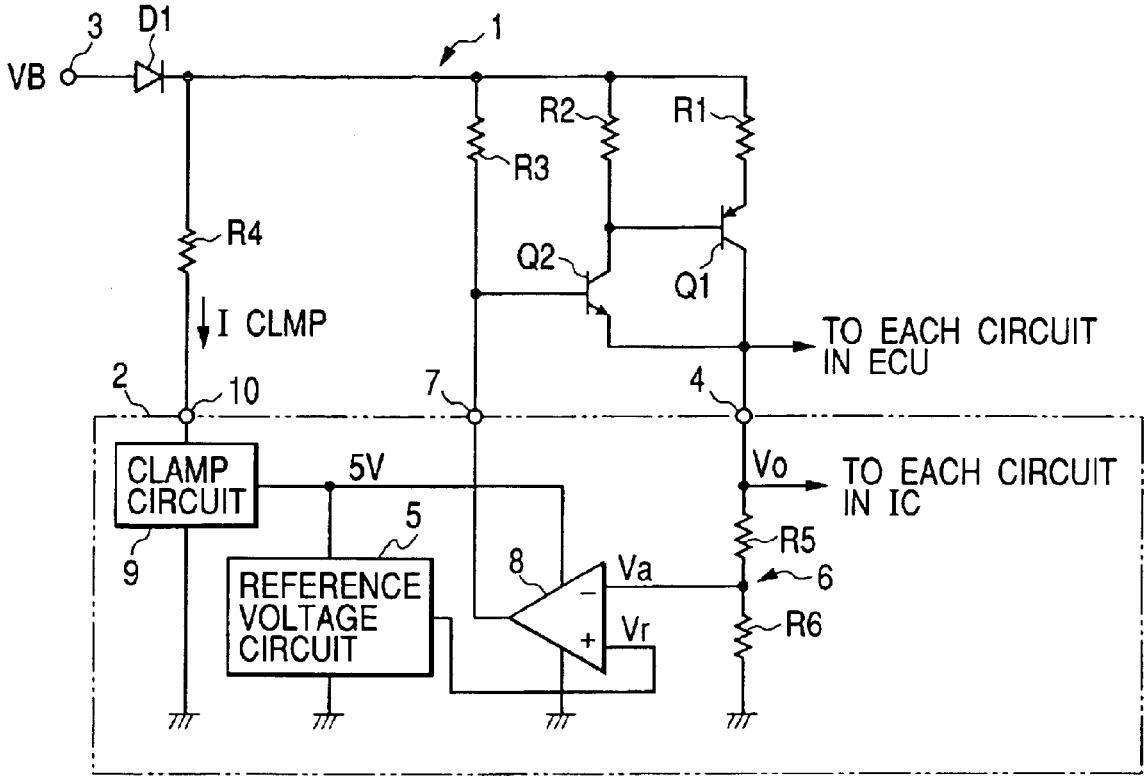
FIG. 3A PRIOR ART
FIG. 3A is a circuit diagram showing a conventional power supply circuit.
Figure 3B:
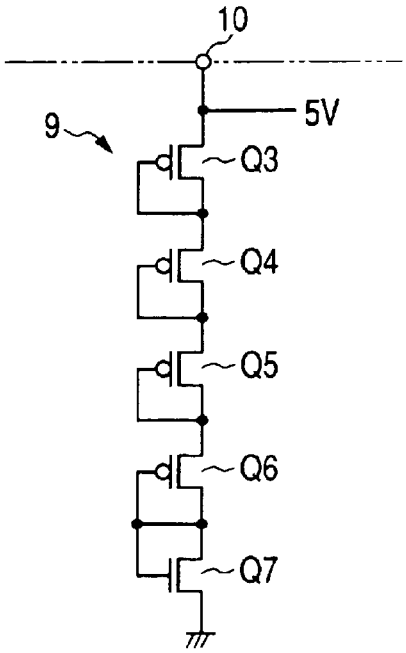
FIG. 3B PRIOR ART
FIG. 3B is a circuit diagram showing a detailed arrangement of a clamp circuit of the conventional power supply circuit shown in FIG. 3A.

For example, according to the conventional power supply circuit 1 shown in FIG. 3, the sum of a current flowing into the output terminal of the operational amplifier 8 via the terminal 7 and a current flowing into the clamp circuit 9 via the terminal 10 rises up to a higher level of 200 $\mu$A to 500 $\mu$A in a case where the power supply circuit 1 has a rated output of 5V and 300 mA. On the contrary, according to the power supply circuit 11 shown in FIG. 1, the current flowing into the output terminal of operational amplifier 21 via the terminal 16 remains in the range of 30 $\mu$A to 60 $\mu$A. A total current consumption of the reference voltage circuit 20 and the operational amplifier 21 is in the range from 20 $\mu$A to 30 $\mu$A. The sixth to eighth resistors R16 to R18 in the startup circuit 23 have higher resistance values (in the level of several MΩ). Thus, it becomes possible to sufficiently reduce the overall current consumption in the startup circuit 23. Hence, the power supply circuit 11 of the present invention makes it possible to greatly reduce the current consumption compared with the conventional power supply circuit 1.

The output voltage Vo generated from the power supply circuit 11 is supplied as the power source voltage to each of the reference voltage circuit 20 and the operational amplifier 21. The output voltage Vo is low during a rising phase of the power source voltage. In such a case, the constant voltage control based on the feedback control performed by the operational amplifier 21 becomes unstable. There is the possibility that the output voltage Vo cannot reach a target voltage or may take a long time to reach the target voltage. The purpose of providing the startup circuit 23 is to eliminate the above-described unstable condition of the constant voltage control performed by the operational amplifier 21.

Hereinafter, the function of the startup circuit 23 will be explained with reference to the voltage waveforms shown in FIG. 2. In the following explanation and in FIG. 2, the forward voltage of the diode D11 is regarded as 0.

Figure 2:
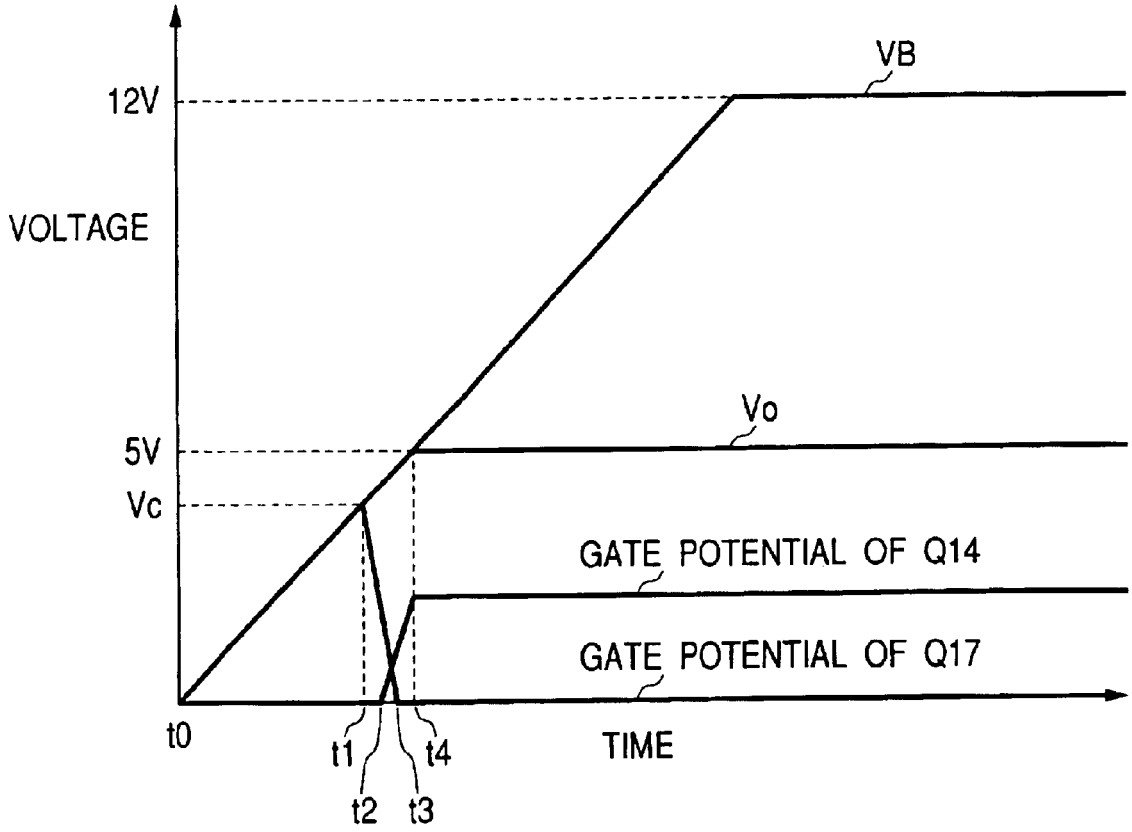
FIG. 2 is a time diagram showing waveforms of various portions of the power supply circuit during the rising phase of a power source voltage.

FIG. 2 shows the waveforms of battery voltage VB, the output voltage Vo, the gate potential of transistor Q14, and the gate potential of transistor Q17 during the rising phase of the power source voltage.

According to the time diagram shown in FIG. 2, an ignition switch (not shown) of the automotive vehicle is turned on at the time t0. The battery voltage VB, which is entered from the power input terminal 13 of the power supply circuit 11, starts increasing in response to the turning-on operation of the ignition switch.

As described later, the output transistor Q14 of the operational amplifier 21 is fixed to a turned-off state during an initial period where the battery voltage VB is low. All of the current flowing across the third resistor R13 becomes the base current of transistor Q12. In response to this base current, the transistor Q12 turns on and supplies a sufficient amount of base current to the transistor Q11. The base current supplied to the transistor Q11 in this case serves as a second drive signal of the present invention. When the transistor Q11 is in a turned-on state, the output voltage Vo of the terminal 14 is substantially equal to the battery voltage VB.

During the above-described low voltage duration, the transistor Q15 is in a turned-off state until the battery voltage VB exceeds a threshold voltage Vthp of P-channel transistor Q15 of the startup circuit 23. The transistors Q13 and Q16 are also in a turned-off state correspondingly. Hence, the output voltage Vo (substantially equal to the battery voltage VB) is applied via the eighth resistor R18 to the gate of transistor Q17. When the output voltage Vo exceeds a threshold voltage Vthn of N-channel transistor Q17, the transistor Q17 turns on. The gate potential of transistor Q14 is thus substantially fixed to 0V. The transistor Q14 keeps a turned-off state irrespective of the differential amplification signal supplied from the differential amplification section of the operational amplifier 21. The transistor Q13 is necessary to surely disconnect the terminal 16 from the ground line 18 when the output voltage Vo is less than the threshold voltage Vthn.

When the battery voltage VB exceeds the threshold voltage Vthp of the transistor Q15, both of the transistors Q15 and Q13 turn on. The output voltage Vo (substantially equal to the battery voltage VB) reaches a voltage Vc expressed by the following formula at the time t1. The transistor Q16 turns on and accordingly the gate potential of transistor Q17 starts reducing. The voltage Vc is set to a predetermined level so as to assure stable operation of the reference voltage circuit 20 and the operational amplifier 21.

$$Vc=Vthp+(R16+R17)/R17\cdot Vthn \quad (1)$$

where R16 and R17 represent resistance values of the sixth and seventh resistors R16 and R17, respectively.

When the gate potential of transistor Q17 approaches the threshold voltage Vthn, a drain-source voltage of the transistor Q17 (i.e., the gate potential of transistor Q14) starts increasing at the time t2. Subsequently, the gate potential of transistor Q17 becomes lower than the threshold voltage Vthn at the time t3. The transistor Q17 turns off completely. Thus, the above-described open-loop control terminates.

Succeeding the above-described open-loop control, the feedback control (i.e., closed-loop control) based on a difference between the detection voltage Va and the reference voltage Vr starts. In this case, the transistor Q13 is already in the complete turned-off state. As a result, the startup circuit 23 is electrically disconnected from the output section of the operational amplifier 21. In other words, the startup circuit 23 is deactivated. The operational amplifier 21 performs the feedback control to supply a base current to the transistor Q11 from the drive circuit 17. The base current supplied to the transistor Q11 in this case serves as a first drive signal of the present invention. The feedback control performed by the operational amplifier 21 after the time t4 is a constant-voltage control for equalizing the output voltage Vo to the target voltage (5V).

As explained above, the power supply circuit 11 of the above-described embodiment generates the output voltage Vo serving as the power source voltage supplied to each of the reference voltage circuit 20 and the operational amplifier 21 which respectively serve as the control circuit. Furthermore, the power supply circuit 11 of the above-described embodiment includes the startup circuit 23 to surely turn on the transistor Q11 during the initial period where the output voltage Vo is low. According to this circuit arrangement, it becomes possible to eliminate the unstable constant-voltage operation occurring in the rising phase of the power source voltage. Furthermore, it becomes possible to reduce the overall current consumption in the power supply circuit 11. The rising time of output voltage Vo can be also shortened. Even if the input voltage entering in the power input terminal 13 fluctuates, the current consumption does not vary so largely. In this respect, the power supply circuit of the above-described embodiment is preferably applied to any automotive devices installed on a vehicle body and driven by electric power of a battery having relatively large voltage fluctuations.

Furthermore, according to the circuit arrangement of the power supply circuit 11, the shutoff transistor Q13 is serially connected to the output transistor Q14 of operational amplifier 21. During the low-voltage condition where the gate potential of transistor Q14 tends to become unstable, the shutoff transistor Q13 surely turns off. In this case, the N-channel transistor Q17 controls the turning on-and-off of transistor Q14, and the P-channel transistor Q15 controls the turning on-and-off of transistor Q13. Hence, it becomes possible to steadily increase the output voltage Vo during the rising phase of the power source voltage.

As apparent from the foregoing description, the preferred embodiment of the present invention provides the main transistor (Q11) provided in the current path extending from the power input terminal (13) to the power output terminal (14) of the power supply circuit (11). The main transistor (Q11) has a function of lowering or reducing a voltage in accordance with a drive signal supplied to its control terminal. The voltage detecting circuit (19) is provided for detecting the output voltage (Vo) appearing from the power output terminal (14). The voltage control circuit, operable in response to the output voltage (Vo) produced from the output terminal (14) of the power supply circuit (11), performs a closed-loop control to supply a first drive signal to the main transistor (Q11) so that the output voltage (Vo) detected by the voltage detecting circuit (19) can be equalized to a target voltage. And, the startup circuit (23) performs a control to supply a second drive signal to the main transistor (Q11) so that the main transistor (Q11) can surely turn on during a low output voltage period where the output voltage (Vo) is lower than a predetermined voltage.

According to this arrangement, the power supply circuit (11) supplies its output voltage (Vo) as the power source voltage to the voltage control circuit. There is no necessity of providing a special power source for driving the voltage control circuit. Hence, compared with a conventional power supply circuit requiring a special power source (e.g., a clamp circuit), it becomes possible to reduce the current consumption required for activating such a special power source.

However, according to this arrangement, a problem still remaining is that the closed-loop control performed by the voltage control circuit becomes unstable during the rising phase of the power source voltage or when the output voltage (Vo) is lower than a predetermined level. There is a possibility that the output voltage (Vo) cannot reach a target voltage or may take a long time to reach the target voltage.

To solve this problem, the above-described preferred embodiment of the present invention interrupts the closed-loop control performed by the voltage control circuit during the low output voltage period where the output voltage (Vo) is lower than a predetermined voltage. Instead, the above-described preferred embodiment of the present invention provides the startup circuit (23) which performs the control during the low output voltage period. More specifically, during the low output voltage period, the second drive signal is supplied to the main transistor (Q11) so that the main transistor (Q11) can surely turn on irrespective of the output voltage (Vo). Accordingly, the output voltage quickly and steadily increases during the rising phase of the power source voltage.

After the output voltage (Vo) reached a predetermined level, the power supply circuit (11) starts an ordinary closed-loop control to equalize the output voltage (Vo) to the target voltage. The startup circuit (23) is a signal processing circuit whose current consumption is small. Hence, an overall current consumption of the power supply circuit (11) can be kept within a lower level.

It is preferable that the power supply circuit further comprises the reference voltage circuit (20) which is operable in response to the output voltage (Vo) produced from the output terminal (14) and generates the reference voltage (Vr) corresponding to the target voltage.

According to this arrangement, the power supply circuit (11) supplies its output voltage (Vo) as the power source voltage to the reference voltage generating circuit. There is no necessity of providing a special power source for driving the reference voltage generating circuit. Hence, it becomes possible to further reduce the overall current consumption in the power supply circuit (11).

It is preferable that the voltage control circuit and the startup circuit (23) are constituted by the single operational amplifier (21) including the output transistor (Q14). The drive circuit (17), interposing between the operational amplifier (21) and the main transistor (Q11), drives the main transistor (Q11). And, the startup circuit (23) fixes the control terminal of the output transistor (Q14) of the operational amplifier (21) to a predetermined potential so that the drive circuit (17) can supply the second drive signal to the main transistor (Q11) during the low output voltage period.

According to this arrangement, the drive circuit (17) supplies the second drive signal to the main transistor (Q11) to surely turn on the main transistor (Q11).

It is preferable that the drive circuit (17) supplies the second drive signal to the main transistor (Q11) under the condition where the output transistor (Q14) of the operational amplifier (21) is in a turned-off state. And, the startup circuit (23) includes the shutoff transistor (Q13) which is serially connected to the output transistor (Q14) of the operational amplifier (21) and is in a turned-off state during the low output voltage period.

According to this arrangement, the output voltage (Vo) steadily increases during the rising phase of the power source voltage.

It is preferable that the power input terminal (13) receives a battery voltage. In general, the battery voltage has large fluctuations which lead to a great amount of current consumption in the conventional power supply circuit requiring addition of a special power source. Accordingly, the power supply circuit (11) of the above-described embodiment is preferably applicable to any automotive devices installed on a vehicle body and driven by electric power of a battery having relatively large voltage fluctuations. The current consumption can be reduced greatly.

The present invention is not limited to the above-described embodiment and, therefore, can be modified in the following manner.

The startup circuit 23 can be modified in such a manner that a transistor (e.g., transistor Q13) serially connected to the transistor Q14 is turned off during a period where the output voltage is low, instead of turning off the transistor Q14 of the operational amplifier 21.

It is possible to adequately determine the adoption of the transistor Q13 considering the shutoff characteristics of the transistor Q14 during the low output voltage period.

According to the circuit arrangement that the transistor Q11 turns on in response to the current supplied from the operational amplifier 21 to the drive circuit 17, it is preferable to provide an output transistor interposing between the terminal 14 and the output terminal of operational amplifier 21 so that the provided output transistor sufficiently turns on during the low output voltage period.

The reference voltage generating circuit is not limited to a band-gap reference voltage circuit and, therefore, can be constituted by any other reference voltage circuit.

What is claimed is:

1. A power supply circuit comprising:

a main transistor, provided in a current path extending from a power input terminal to a power output terminal, for lowering a source voltage applied from a power supply circuit through the power input terminal in accordance with a given drive signal;

a voltage detecting circuit for detecting an output voltage outputted from the main transistor at said power output terminal and outputting the detected output voltage;

a voltage control circuit, operable in response to said output voltage of the main transistor, for performing a closed-loop control to supply a first drive signal to said main transistor as a given drive signal so that the output voltage detected by said voltage detecting circuit is equalized to a target voltage; and a startup circuit, operable in response to the output voltage of the main transistor during a low output voltage period where the output voltage is lower than a predetermined voltage, for supplying a second drive signal to said main transistor as the given drive signal to control said main transistor to be turned on such that the output voltage is substantially equal to the source voltage of the power supply circuit.

2. The power supply circuit in accordance with claim 1, further comprising a reference voltage circuit, operable in response to said output voltage produced from the output terminal, for generating a reference voltage corresponding to said target voltage.

3. The power supply circuit in accordance with claim 1, wherein said voltage control circuit and said startup circuit are constituted by a single operational amplifier including an output transistor, a drive circuit interposes between said operational amplifier and said main transistor for driving said main transistor, and said startup circuit fixes a control terminal of said output transistor of said operational amplifier to a predetermined potential so that said drive circuit can supply said second drive signal to said main transistor during said low output voltage period.

4. The power supply circuit in accordance with claim 3, wherein said drive circuit supplies said second drive signal to said main transistor under a condition where said output transistor of said operational amplifier is in a turned-off state, and said startup circuit includes a shutoff transistor which is serially connected to said output transistor of said operational amplifier and is in a turned-off state during said low output voltage period.

5. The power supply circuit in accordance with claim 1, wherein the power supply circuit is a battery.

6. The power supply circuit in accordance with claim 1, wherein the voltage control circuit performs the closed-loop control during a normal period where the output voltage of the main transistor is equal to or higher than the predetermined voltage.

7. The power supply circuit in accordance with claim 1, wherein the target voltage is equal to the predetermined voltage.

* * * * *